US011624173B2

(12) United States Patent
Zhang et al.

(10) Patent No.: US 11,624,173 B2
(45) Date of Patent: Apr. 11, 2023

(54) DUAL-OUTLET FAUCET AND DUAL-OUTLET FAUCET SYSTEM

(71) Applicant: Xiamen Forbetter Sanitary Ware Co., Ltd., Fujian (CN)

(72) Inventors: Xingui Zhang, Xiamen (CN); Yihui Chen, Xiamen (CN); Mouyong Lin, Xiamen (CN)

(73) Assignee: XIAMEN FORBETTER SANITARY WARE CO., LTD., Fujian (CN)

( * ) Notice: Subject to any disclaimer, the term of this patent is extended or adjusted under 35 U.S.C. 154(b) by 315 days.

(21) Appl. No.: 17/118,614

(22) Filed: Dec. 11, 2020

(65) Prior Publication Data

US 2022/0186476 A1 Jun. 16, 2022

(51) Int. Cl.
*E03C 1/04* (2006.01)

(52) U.S. Cl.
CPC .... *E03C 1/0405* (2013.01); *E03C 2001/0415* (2013.01)

(58) Field of Classification Search
CPC ..... E03C 1/0405; E03C 1/0404; E03C 2001/0415
USPC ..... 4/677
See application file for complete search history.

(56) References Cited

U.S. PATENT DOCUMENTS

| | | | | |
|---|---|---|---|---|
| 2021/0079634 | A1* | 3/2021 | Rosandich | E03C 1/0405 |
| 2022/0112700 | A1* | 4/2022 | Stupp | E03C 1/0405 |
| 2022/0145600 | A1* | 5/2022 | Tueshaus | E03C 1/0404 |
| 2022/0325508 | A1* | 10/2022 | Kim | E03C 1/0405 |

* cited by examiner

*Primary Examiner* — Huyen D Le
(74) *Attorney, Agent, or Firm* — Leong C. Lei

(57) ABSTRACT

A dual-outlet faucet and a dual-outlet faucet system are disclosed. The dual-outlet faucet has two water channels to output two different types of water flows, which is convenient for the user to use. The dual-outlet faucet system includes the dual-outlet faucet and a water treatment apparatus. The dual-outlet faucet system can output the normal water and the water processed by the water treatment apparatus, which is convenient for the user to use.

15 Claims, 10 Drawing Sheets

DUAL-OUTLET FAUCET AND DUAL-OUTLET FAUCET SYSTEM

BACKGROUND OF THE INVENTION

1. Field of the Invention

The present invention relates to a kitchen faucet, and more particularly to a dual-outlet faucet and a dual-outlet faucet system.

2. Description of the Prior Art

Most of conventional faucets have a single water channel. When the user wants to use the water (such as purified water purified by a water purifier, ozone water containing ozone, and the like) that has been treated by a water treatment apparatus, it is necessary to install an additional faucet that occupies a space and is costly. Therefore, it is hoped that a faucet can realize two water channels, one for outputting the normal water and the other for outputting the water processed by the water treatment apparatus.

SUMMARY OF THE INVENTION

The primary object of the present invention is to provide a dual-outlet faucet with two water channels. The present invention further provides a dual-outlet faucet system, which can output two different types of water flows. In order to achieve the above object, the present invention adopts the following solutions.

A dual-outlet faucet comprises a faucet body, a control valve, and a spout assembly. The faucet body includes a hollow main body and a spout body. The spout body is connected to the main body. The control valve is installed on the main body. The control valve includes a valve seat and a control valve core matched with the valve seat. The valve seat has a cold water inlet, a hot water inlet, a mixed water outlet, and a cold water outlet. The control valve core is configured to control the cold water inlet and the hot water inlet to communicate with the mixed water outlet. The control valve core is further configured to control the cold water inlet to communicate with the cold water outlet. The spout assembly includes a first spout tube, a second spout tube, a first spray head, and a second spray head. The first spout tube passes through the spout body and the main body. An inlet end and an outlet end of the first spout tube are connected to the mixed water outlet and the first spray head, respectively. The second spout tube passes through the spout body and the main body. An outlet end of the second spout tube is connected to the second spray head.

Preferably, an outer end of the spout body is formed with an outlet port. The first spout tube movably passes through the spout body and the main body. The second spray head is fixed to the outlet port of the spout body.

Preferably, the second spray head has a mounting hole. The first spray head is movably accommodated in the mounting hole of the second spray head. When the first spray head is accommodated in the mounting hole, an outer end face of the second spray head is flush with an outer end face of the first spray head.

Preferably, a partition is provided in the spout body. The partition is configured to separate the first spout tube and the second spout tube.

Preferably, the spout body includes a vertical section and a curved section connected to the vertical section. An outer end of the curved section is formed with the outlet port. The partition includes a partition sleeve and a partition plate connected to the partition sleeve. The partition sleeve is fitted in the vertical section. The first spout tube is inserted through the partition sleeve. The partition plate is a curved plate. The partition plate is fitted in the curved section. The partition plate is sandwiched between the first spout tube and the second spout tube.

Preferably, the partition sleeve and the partition plate are each provided with a clamp for clamping the second spout tube.

Preferably, the main body includes an upright mounting seat and a mounting cylinder connected to a side wall of the mounting seat. An inner cavity of the mounting cylinder communicates with an inner cavity of the mounting seat. The control valve core of the control valve is inserted into the mounting cylinder. The valve seat of the control valve is disposed in the mounting seat and the mounting cylinder. The spout body communicates with the mounting seat. The first spout tube and the second spout tube pass through the mounting seat.

Preferably, a lower portion of the spout body is provided with a connecting section. A side wall of the connecting section is formed with a limiting hole. An inner wall of the mounting seat is formed with an annular groove. The annular groove is fitted with a rotatable C-shaped ring. The connecting section is inserted into the C-shaped ring. The C-shaped ring is provided with a limiting elastic plate. An inner side of the limiting elastic plate is provided with a limiting block to be engaged with the limiting hole.

Preferably, the limiting block is provided with a guide slope that is inclined in a top-down direction to the inner side of the limiting elastic plate.

Preferably, an inner wall of the C-shaped ring is formed with a positioning plane. An outer wall of the connecting section of the spout body is formed with a connecting plane to be pressed against the positioning plane. An inner wall of the annular groove of the mounting seat is formed with a recess.

Preferably, the connecting section is provided with a positioning protrusion extending downwardly. The inner wall of the mounting seat is provided with a positioning portion that extends inwardly and is configured to lean against a side of the positioning protrusion. When the connecting section is rotated until the side of the positioning protrusion of the connecting section leans against the positioning portion of the mounting seat, the connecting section drives the C-shaped ring to rotate until the limiting elastic plate of the C-shaped ring faces the recess.

Preferably, the valve seat is formed with a notch located in the mounting seat. The first spout tube and the second spout tube pass through the notch of the valve seat.

Preferably, the valve seat includes a main valve seat and a connecting head that are formed by injection molding. The connecting head is connected to one side of the main valve seat. The notch is formed between the connecting head and the main valve seat.

Preferably, the main valve seat has an accommodating cavity, the cold water inlet, the hot water inlet, and the mixed water outlet. The cold water inlet, the hot water inlet and the mixed water outlet face downwardly. The accommodating cavity is provided with a first cold water entrance, a second cold water entrance, a hot water entrance, a mixed water exit and a cold water exit that are arranged parallel to each other. The first cold water entrance and the second cold water entrance are in communication with the cold water inlet. The hot water entrance is in communication with the hot water inlet. The mixed water exit is in communication with the mixed water outlet. The connecting head of the valve seat is provided with the cold water outlet and a water passing hole communicating with the cold water outlet. The water passing hole communicates with the cold water outlet. The control valve core is inserted into the accommodating cavity of the main valve seat. The control valve core is configured to control the first cold water entrance and the hot water entrance to communicate with the mixed water exit. The control valve core is further configured to control the second cold water entrance to communicate with the cold water exit.

A dual-outlet faucet system comprises a water treatment apparatus and the foregoing dual-outlet faucet. An inlet and an outlet of the water treatment apparatus are connected to the cold water outlet of the dual-outlet faucet and an inlet end of the second spout tube, respectively.

After adopting the above solutions, the dual-outlet faucet of the present invention is provided with the first spout tube and the second spout tube, so that the dual-outlet faucet has two water channels. It is convenient for the user to use the normal water and the water processed by the water treatment apparatus. Specifically, when the dual-outlet faucet is in use, the cold water outlet of the valve seat is in communication with the inlet end of the second spout tube through the water treatment apparatus, so that the cold water output from the cold water outlet is processed by the water treatment apparatus to be output from the second spout tube and the second spray head. In this way, when the user controls the mixed water outlet to discharge water by operating the control valve core, the dual-outlet faucet outputs ordinary mixed water. When the user controls the cold water outlet to discharge water by operating the control valve core, the dual-outlet faucet outputs the water processed by the water treatment apparatus. In addition, the water output from the first spout tube and the second spout tube of the dual-outlet faucet can share the cold water input from the cold water inlet. This can reduce the pipeline of the external water source connected to the dual-outlet faucet and simplify the structure.

The dual-outlet faucet system of the present invention comprises the dual-outlet faucet and the water treatment apparatus. The inlet and the outlet of the water treatment apparatus are connected to the cold water outlet of the dual-outlet faucet and the inlet end of the second spout tube, respectively. When the user controls the mixed water outlet to discharge water by operating the control valve core, the dual-outlet faucet system outputs mixed water. When the user controls the cold water outlet to discharge water by operating the control valve core, the cold water output from the cold water outlet is processed by the water treatment apparatus and then output through the second spout tube and the second spray head. At this time, the dual-outlet faucet system outputs the water processed by the water treatment equipment.

DETAILED DESCRIPTION OF THE PREFERRED EMBODIMENTS

Figure 1:
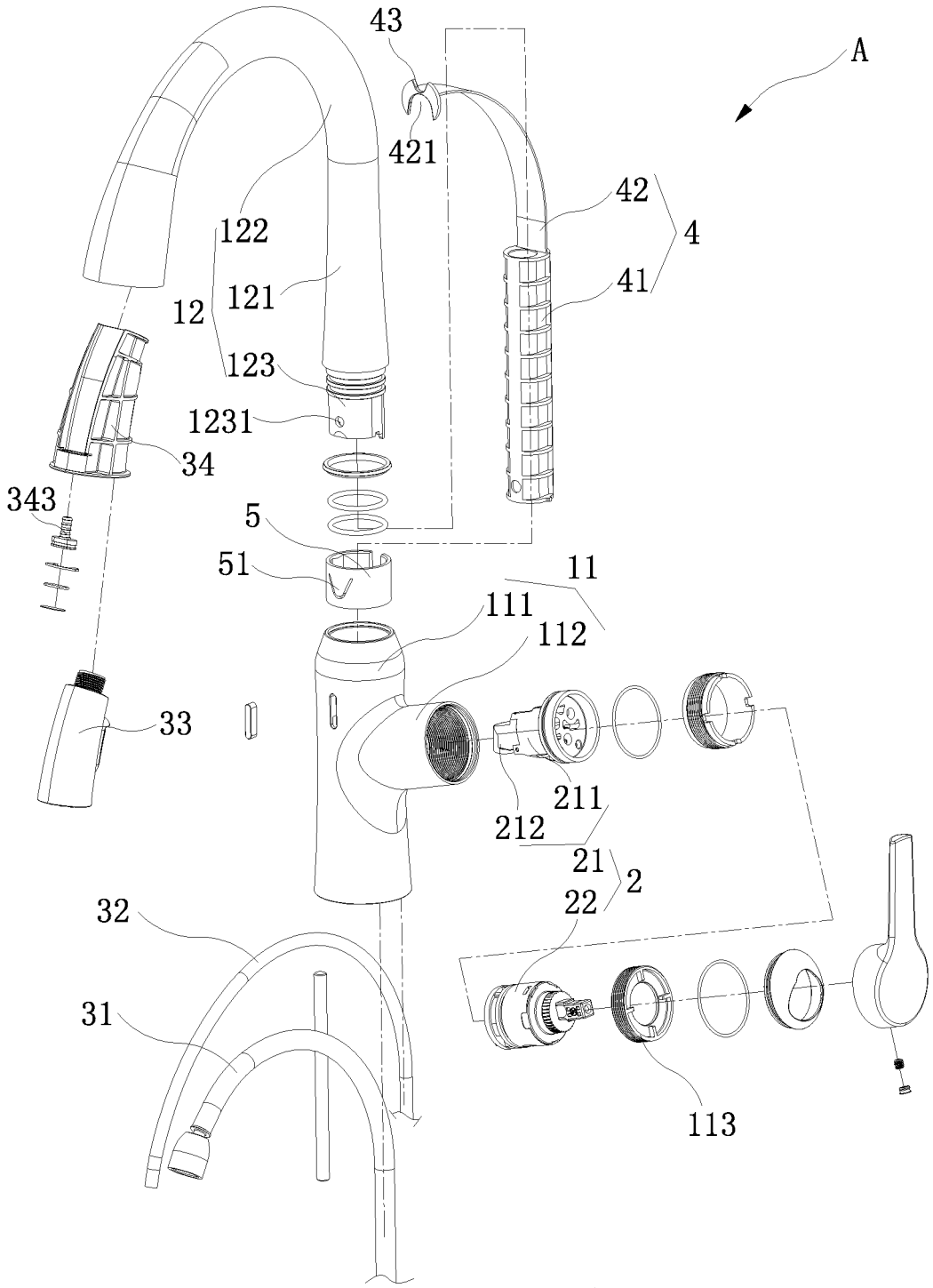
FIG. 1 is an exploded view of the dual-outlet faucet of the present invention.
Figure 2:
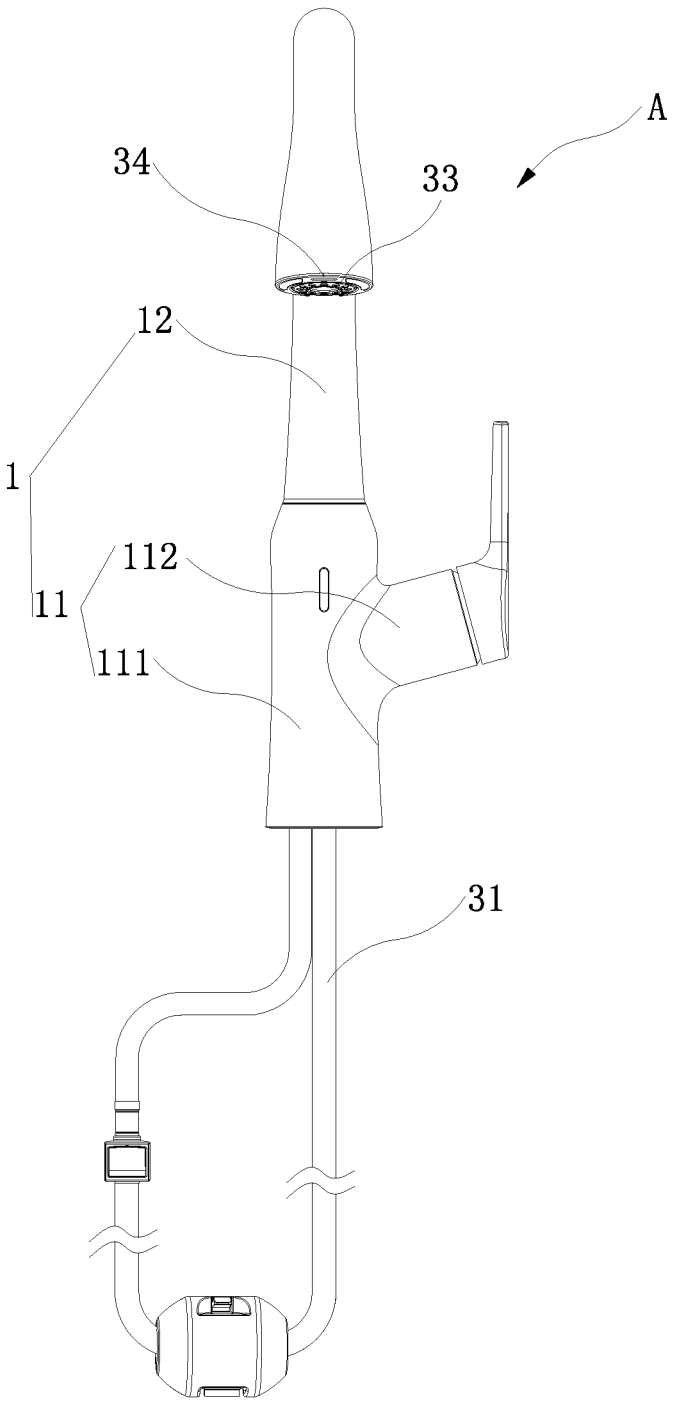
FIG. 2 is a perspective view of the dual-outlet faucet of the present invention.

Embodiments of the present invention will now be described, by way of example only, with reference to the accompanying drawings.

As shown in FIGS. 1 to 15, the present invention discloses a dual-outlet faucet A, comprising a faucet body 1, a control valve 2 and a spout assembly 3. The faucet body 1 includes a hollow main body 11 and a spout body 12. The spout body 12 is connected to the main body 11. The control valve 2 is installed on the main body 11. The control valve 2 includes a valve seat 21 and a control valve core 22 matched with the valve seat 21. The valve seat 21 has a cold water inlet 2111, a hot water inlet 2112, a mixed water outlet 2113, and a cold water outlet 2121. The cold water inlet 2111 and the hot water inlet 2112 are configured to input cold water and hot water, respectively. The mixed water outlet 2113 is configured to output mixed water. The cold water outlet 2121 is configured to output cold water to a water treatment apparatus B. The control valve core 22 is configured to control the cold water inlet 2111 and the hot water inlet 2112 to communicate with the mixed water outlet 2113, so as to control the water flow and water temperature of the mixed water outlet 2113. The control valve core 22 is further configured to control the cold water inlet 2111 to communicate with the cold water outlet 2121, so as to control the water flow of the cold water outlet 2121. The spout assembly 3 includes a first spout tube 31, a second spout tube 32, a first spray head 33, and a second spray head 34. The first spout tube 31 passes through the spout body 12 and the main body 11. An inlet end and an outlet end of the first spout tube 31 are connected to the mixed water outlet 2113 and the first spray head 33, respectively. The second spout tube 32 passes through the spout body 12 and the main body 11. An outlet end of the second spout tube 32 is connected to the second spray head 34. An inlet end of the second spout tube 32 is connected to the water treatment apparatus B, so that the water processed by the water treatment apparatus B can be output through the second spout tube 32 and the second spray head 34.

The dual-outlet faucet A of the present invention is provided with the first spout tube 31 and the second spout tube 32, so that the dual-outlet faucet A has two water channels. It is convenient for the user to use the normal water and the water processed by the water treatment apparatus B. Specifically, when the dual-outlet faucet A is in use, the cold water outlet 2121 of the valve seat 21 is in communication with the inlet end of the second spout tube 32 through the water treatment apparatus B, so that the cold water output from the cold water outlet 2121 is processed by the water treatment apparatus B to be output from the second spout tube 32 and the second spray head 34. In this way, when the user controls the mixed water outlet 2113 to discharge water by operating the control valve core 22, the dual-outlet faucet A outputs ordinary mixed water. When the user controls the cold water outlet 2121 to discharge water by operating the control valve core 22, the dual-outlet faucet A outputs the water processed by the water treatment apparatus B. In addition, the water output from the first spout tube 31 and the second spout tube 32 of the dual-outlet faucet A can share the cold water input from the cold water inlet 2111. This can reduce the pipeline of the external water source connected to the dual-outlet faucet A and simplify the structure.

As shown in FIG. 3, FIG. 3A, FIG. 3B, FIG. 4 and FIG. 5, an outer end of the spout body 12 is formed with an outlet port 1221. The first spout tube 31 movably passes through the spout body 12 and the main body 11. The second spray head 34 is fixed to the outlet port 1221 of the spout body 12. In this way, the first spray head 33 is movable relative to the spout body 12, and the second spray head 34 is not movable relative to the spout body 12, so that the user can distinguish the first spray head 33 from the second spray head 34. The user can move the first spray head 33 to use normal mixed water output from the first spray head 33 for cleaning.

Figure 3:
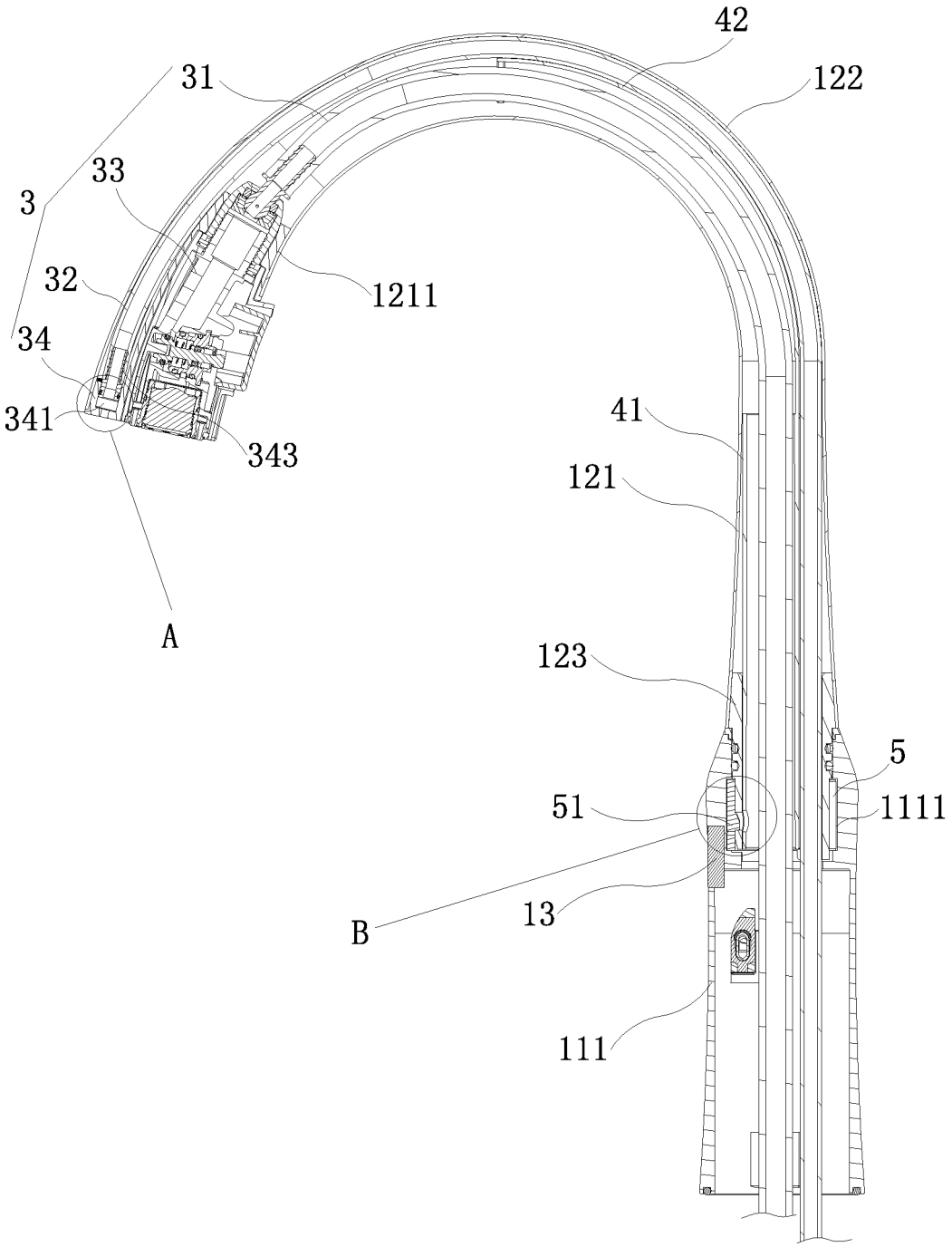
FIG. 3 is a first cross-sectional view of the dual-outlet faucet of the present invention.
Figure 3A:
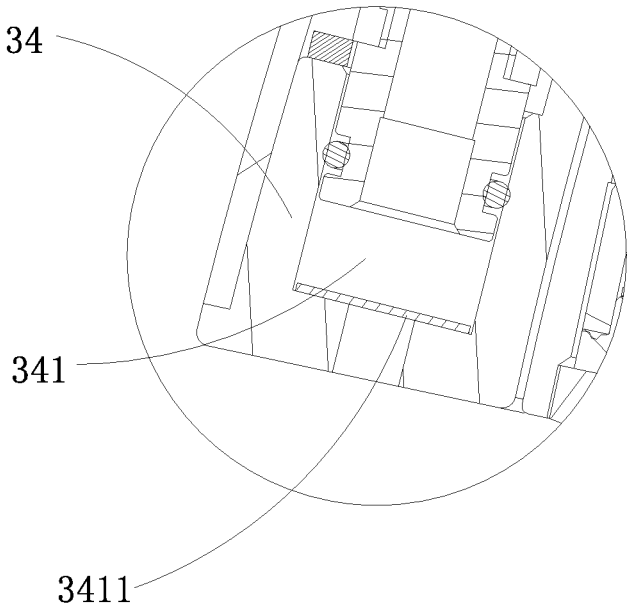
FIG. 3A is an enlarged view of circle A of FIG. 3.
Figure 3B:
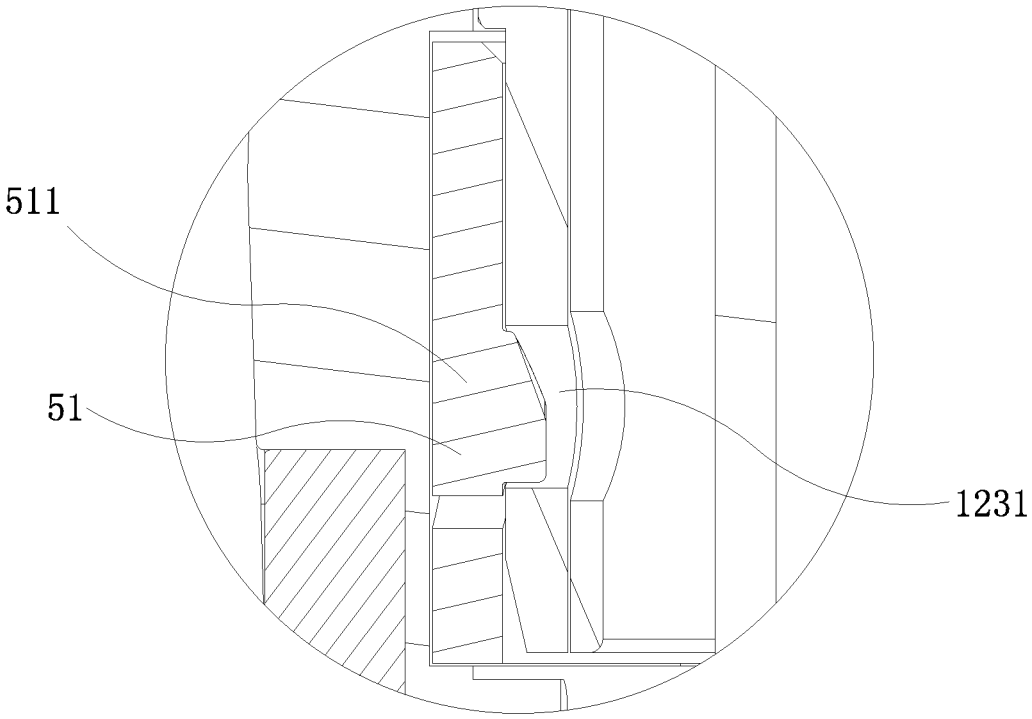
FIG. 3B is an enlarged view of circle B of FIG. 3.
Figure 8:
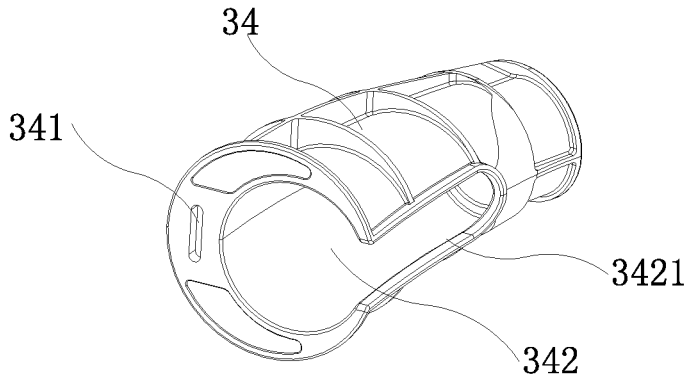
FIG. 8 is a first schematic view of the second spray head of the present invention.
Figure 9:
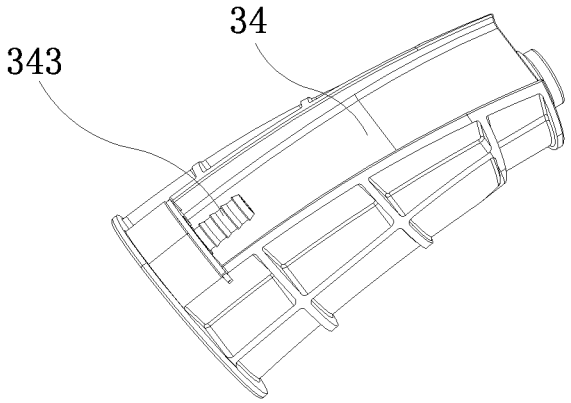
FIG. 9 is a second schematic view of the second spray head of the present invention.
Figure 10:
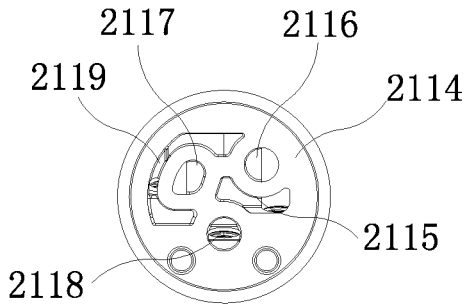
FIG. 10 is a first schematic view of the valve seat of the present invention.
Figure 11:
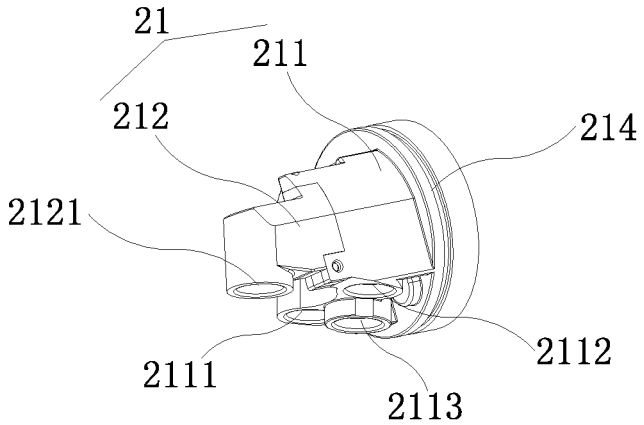
FIG. 11 is a second schematic view of the valve seat of the present invention.

As shown in FIGS. 3, 8 and 9, the second spray head 34 has a through hole 341. The outlet end of the second spout tube 32 is in communication with the through hole 341, so that the water from the second spout tube 32 is output from the through hole 341. The through hole 341 is provided with a connector 343 for connecting the outlet end of the second spout tube 32. The through hole 341 is provided with a filter screen 3411 for filtering water. As shown in FIG. 3 and FIG. 8, the second spray head 34 further has a mounting hole 342. The first spray head 33 is movably accommodated in the mounting hole 342 of the second spray head 34. When the first spray head 33 is accommodated in the mounting hole 342, the outer end face of the second spray head 34 is flush with the outer end face of the first spray head 33. Thus, the appearance of the second spray head 34 and the first spray head 33 is integral and beautiful. The first spray head 33 can select a kitchen spray head having at least two spray modes to meet the user's demand. The kitchen spray head has various spray effects, such as shower water and bubble water.

Figure 4:
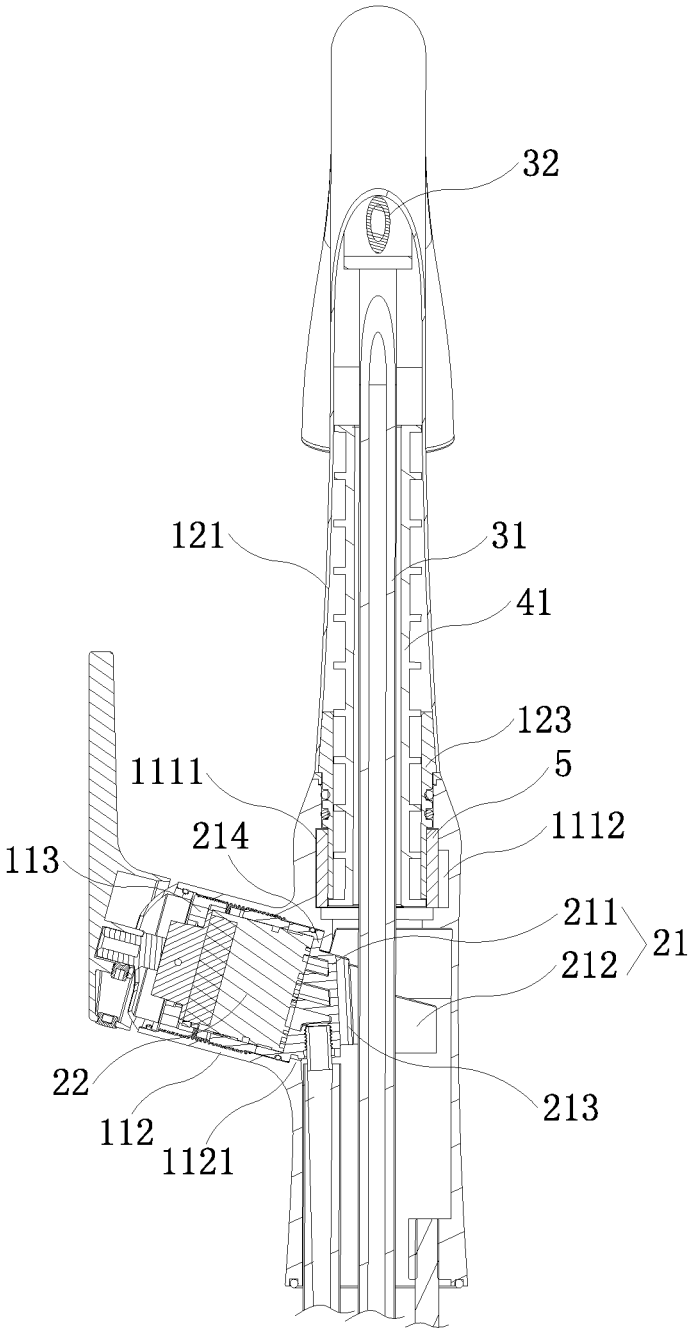
FIG. 4 is a second cross-sectional view of the dual-outlet faucet of the present invention.
Figure 5:
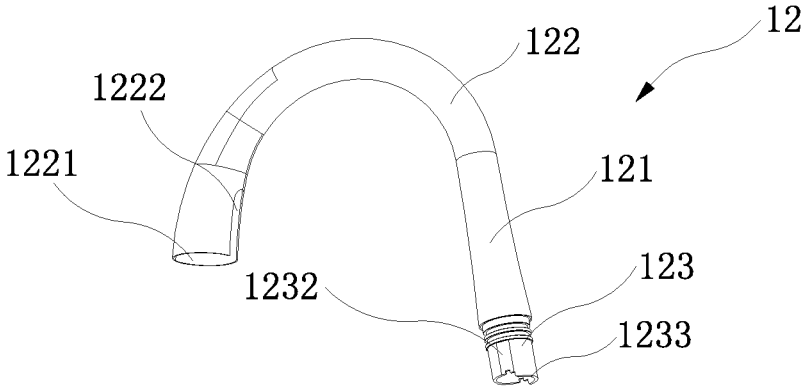
FIG. 5 is a schematic view of the spout body of the present invention.
Figure 6:
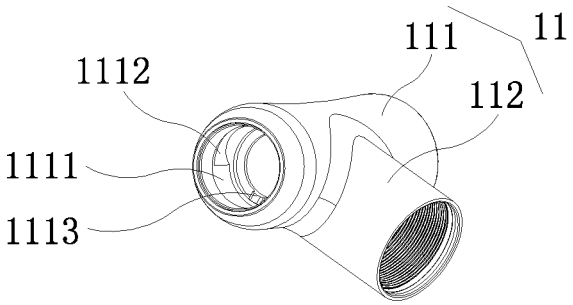
FIG. 6 is a schematic view of the main body of the present invention.
Figure 7:
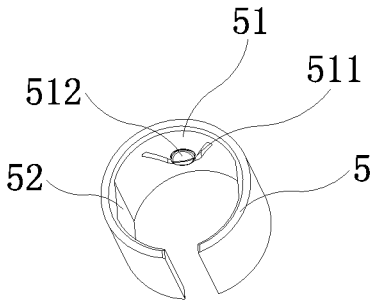
FIG. 7 is a schematic view of the C-shaped ring of the present invention.

As shown in FIG. 1, FIG. 3 and FIG. 4, a partition 4 is provided in the spout body 12. The partition 4 is configured to separate the first spout tube 31 and the second spout tube 32 to prevent the first spout tube 31 and the second spout tube 32 from interfering with each other in the spout body 12, so that the first spout tube 31 can move smoothly. The spout body 12 includes a vertical section 121 and a curved section 122 connected to the vertical section 121. The outer end of the curved section 122 is formed with the outlet port 1221. The partition 4 includes a partition sleeve 41 and a partition plate 42 connected to the partition sleeve 41. The partition sleeve 41 is fitted in the vertical section 121. The first spout tube 31 is inserted through the partition sleeve 41. The partition plate 42 is a curved plate, and the partition plate 42 is fitted in the curved section 122. The partition plate 42 is sandwiched between the first spout tube 31 and the second spout tube 32 to separate the first spout tube 31 and the second spout tube 32. The partition sleeve 41 and the partition plate 42 are each provided with a clamp 43 for clamping the second spout tube 32 to prevent the second spout tube 32 from moving. The partition plate 42 may be provided with a notch 421 for receiving the first spout tube 31, such that the first spout tube 31 is prevented from being displaced through the notch 421.

As shown in FIGS. 1 to 4, the main body 11 includes an upright mounting seat 111 and a mounting cylinder 112 connected to the side wall of the mounting seat 111. The inner cavity of the mounting cylinder 112 communicates with the inner cavity of the mounting seat 111. The spout body 12 communicates with the mounting seat 111. The first spout tube 31 and the second spout tube 32 pass through the mounting seat 111. The control valve core 22 of the control valve 2 is inserted into the mounting cylinder 112. The valve seat 21 of the control valve 2 is disposed in the mounting seat 111 and the mounting cylinder 112.

The lower portion of the spout body 12 is rotatably connected to the mounting seat 111, so that the spout body 12 can be rotated to control the direction of the first spray head 33 and the second spray head 34. Specifically, the lower portion of the spout body 12 is provided with a connecting section 123. The side wall of the connecting section 123 is formed with a limiting hole 1231. The inner wall of the mounting seat 111 is formed with an annular groove 1111. The annular groove 1111 is fitted with a rotatable C-shaped ring 5. The annular groove 1111 is configured to restrict the up and down movement of the C-shaped ring 5. The connecting section 123 is inserted into the C-shaped ring 5. The C-shaped ring 5 is provided with a limiting elastic plate 51. The inner side of the limiting elastic plate 51 is provided with a limiting block 511 to be engaged with the limiting hole 1231. In the present invention, the C-shaped ring 5 and the connecting section 123 rotate together through the cooperation of the limiting block 511 and the limiting hole 1231, and the C-shaped ring 5 is rotatably fitted in the annular groove 1111 of the mounting seat 111, so that the spout body 12 can rotate relative to the mounting seat 111. When the spout body 12, the mounting seat 111 and the C-shaped ring 5 are assembled, the C-shaped ring 5 is first inserted into the mounting seat 111, so that the C-shaped ring 5 is placed into the annular groove 1111 of the mounting seat 111. Then, the connecting section 123 of the spout body 12 is inserted into the C-shaped ring 5, so that the limiting block 511 of the C-shaped ring 5 is engaged with the limiting hole 1231 of the connecting section 123. The limiting block 511 of the C-shaped ring 5 is provided with a guide slope 512 that is inclined in a top-down direction to the inner side of the limiting elastic plate 51. The limiting block 511 can be easily inserted into the limiting hole 1231 through the guide slope 512. The inner wall of the C-shaped ring 5 is formed with a positioning plane 52. The outer wall of the connecting section 123 of the spout body 12 is formed with a connecting plane 1232 to be pressed against the positioning plane 52. The cooperation of the connecting plane 1232 and the positioning plane 52 can achieve a positioning effect, so that the user can quickly align the limiting hole 1231 of the connecting section 123 with the limiting block 511 of the C-shaped ring 5. Moreover, the cooperation of the connecting plane 1232 and the positioning plane 52 enables the connecting section 123 and the C-shaped ring 5 to rotate together. The inner wall of the annular groove 1111 of the mounting seat 111 is formed with a recess 1112. The recess 1112 is configured to provide a space for the limiting elastic plate 51 to be deformed outwardly. In this way, when the spout body 12 is to be removed from the mounting seat 111, the spout body 12 is first rotated so that the connecting section 123 of the spout body 12 drives the C-shaped ring 5 to rotate to a position where the limiting elastic plate 51 of the C-shaped ring 5 faces the recess 1112. Then, an external tool is inserted into the mounting seat 111 to pass through the limiting hole 1231 and push the limiting block 511 to disengage from the limiting hole 1231. When the limiting block 511 is disengaged from the limiting hole 1231, the spout body 12 can be pulled out. When the limiting block 511 of the C-shaped ring 5 is engaged with the limiting hole 1231 of the connecting section 123 of the spout body 12, the connecting section 123 can be inserted into the C-shaped ring 5 first, so that the connecting plane 1232 of the connecting section 123 is against the positioning plane 52 of the C-shaped ring 5. Then, the connecting section 123 is rotated and pressed down. When the connecting section 123 drives the C-shaped ring 5 to rotate to the position where the limiting elastic plate 51 of the C-shaped ring 5 faces the recess 1112, the limiting elastic plate 51 is deformed so that the limiting block 511 of the C-shaped ring 5 is locked into the limiting hole 1231 of the connecting section 123. In order to quickly align the limiting elastic plate 51 the C-shaped ring 5 with the recess 1112, the connecting section 123 is provided with a positioning protrusion 1233 extending downwardly, and the inner wall of the mounting seat 111 is provided with a positioning portion 1113 that extends inwardly and is configured to lean against the side of the positioning protrusion 1233. When the connecting section 123 is rotated until the side of the positioning protrusion 1233 of the connecting section 123 leans against the positioning portion 1113 of the mounting seat 111, the connecting section 123 drives the C-shaped ring 5 to rotate until the limiting elastic plate 51 of the C-shaped ring 5 faces the recess 1112.

Figure 12:
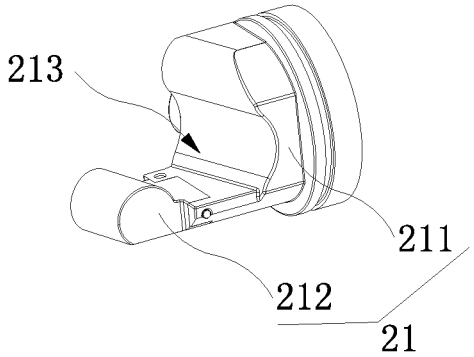
FIG. 12 is a third schematic view of the valve seat of the present invention.
Figure 13:
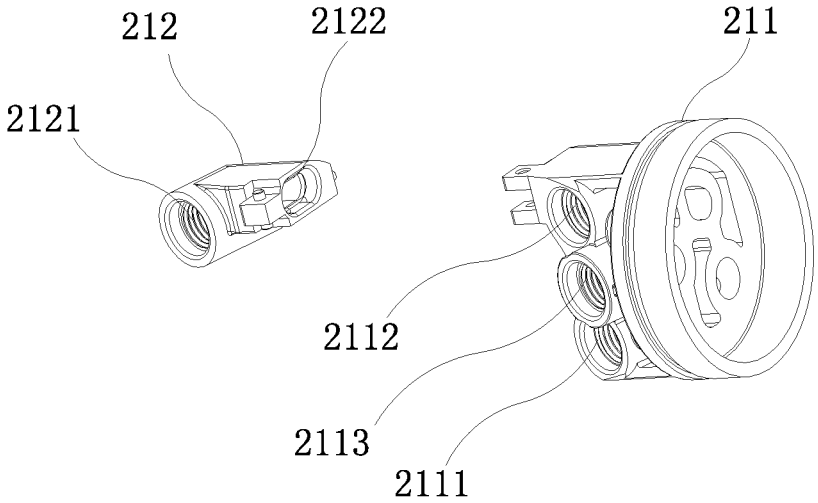
FIG. 13 is a first exploded view of the valve seat of the present invention.
Figure 14:
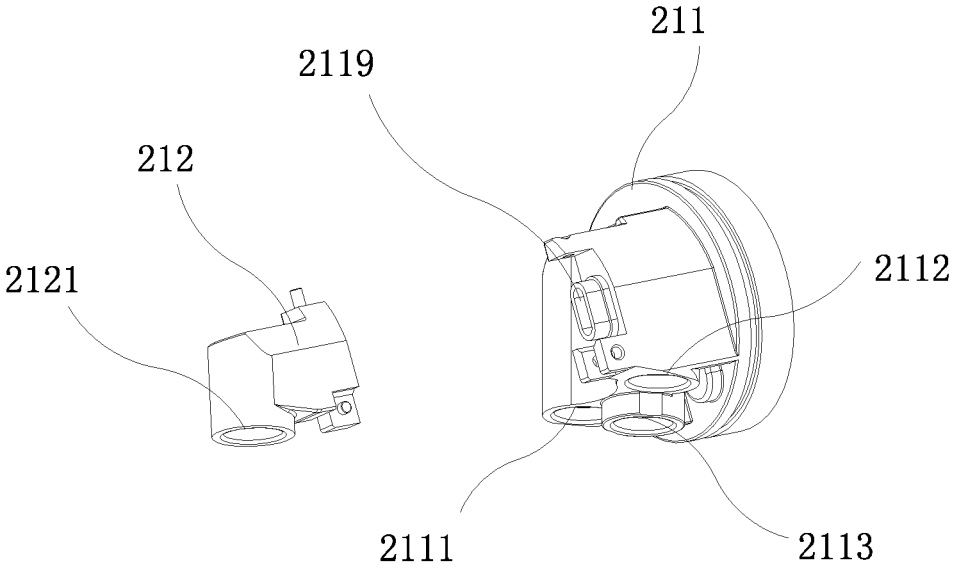
FIG. 14 is a second exploded view of the valve seat of the present invention.

As shown in FIG. 4 and FIG. 12, the valve seat 21 of the control valve 2 is formed with a notch 213 located in the mounting seat 111. The first spout tube 31 and the second spout tube 32 pass through the notch 213 of the valve seat 21. In this way, the notch 213 provides a space for installing the first spout tube 31 and the second spout tube 32, so that the inner diameter of the mounting seat 111 can be made smaller. This can reduce the volume of the mounting seat 111. The valve seat 21 includes a main valve seat 211 and a connecting head 212 that are formed by injection molding. The connecting head 212 is connected to one side of the main valve seat 211. The notch 213 is formed between the connecting head 212 and the main valve seat 211. In this way, the cost of the valve seat 21 is low, and the main valve seat 211 and the connecting head 212 that are formed by injection molding will not pollute the water. The main valve seat 211 has an accommodating cavity 2114, the cold water inlet 2111, the hot water inlet 2112, and the mixed water outlet 2113. The cold water inlet 2111, the hot water inlet 2112 and the mixed water outlet 2113 face downwardly. The accommodating cavity 2114 is provided with a first cold water entrance 2115, a second cold water entrance 2116, a hot water entrance 2117, a mixed water exit 2118 and a cold water exit 2119 that are arranged parallel to each other. The first cold water entrance 2115 and the second cold water entrance 2116 are in communication with the cold water inlet 2111. The hot water entrance 2117 is in communication with the hot water inlet 2112. The mixed water exit 2118 is in communication with the mixed water outlet 2113. The connecting head 212 is provided with the cold water outlet 2121 and a water passing hole 2122 communicating with the cold water outlet 2121. The water passing hole 2122 communicates with the cold water outlet 2119.

As shown in FIG. 4, the outer wall of the main valve seat 211 of the control valve 2 is provided with a flange 214. The opening where the mounting cylinder 112 connects with the mounting seat 111 is provided with a stop edge 1121. The valve seat 21 is inserted from the mounting cylinder 112 into the mounting seat 111, and the stop edge 1121 stops the flange 214 to prevent the valve seat 21 from falling. The control valve core 22 of the control valve 2 is fitted into the mounting cylinder 112, and the control valve core 22 is inserted into the accommodating cavity 2114 of the main valve seat 211. The mounting cylinder 112 is provided with a gland nut 113 for pressing the control valve core 22 to prevent the control valve core 22 from falling out of the mounting cylinder 112. The control valve core 22 is configured to control the first cold water entrance 2115 and the hot water entrance 2117 to communicate with the mixed water exit 2118, so as to control the water flow and water temperature of the mixed water outlet 2113. The control valve core 22 is further configured to control the second cold water entrance 2116 to communicate with the cold water exit 2119, so as to control the water flow of the cold water outlet 2121. The control valve core 22 may adopt a conventional three-in and two-out valve core. The three-in and two-out valve core can control the water flow and water temperature of the mixed water outlet 2113 and the water flow of the cold water outlet 2121. The structure of the three-in two-out valve core can use the structure disclosed in Chinese Utility Model Publication CN204328076U. The control valve core 22 may adopt a conventional two-in and two-out valve core. The two-in and two-out valve core can control the water flow and water temperature of the mixed water outlet 2113 and the water flow of the cold water outlet 2121. The structure of the two-in two-out valve core may adopt the structure disclosed in Chinese Utility Model Publication CN210440617U.

Figure 15:
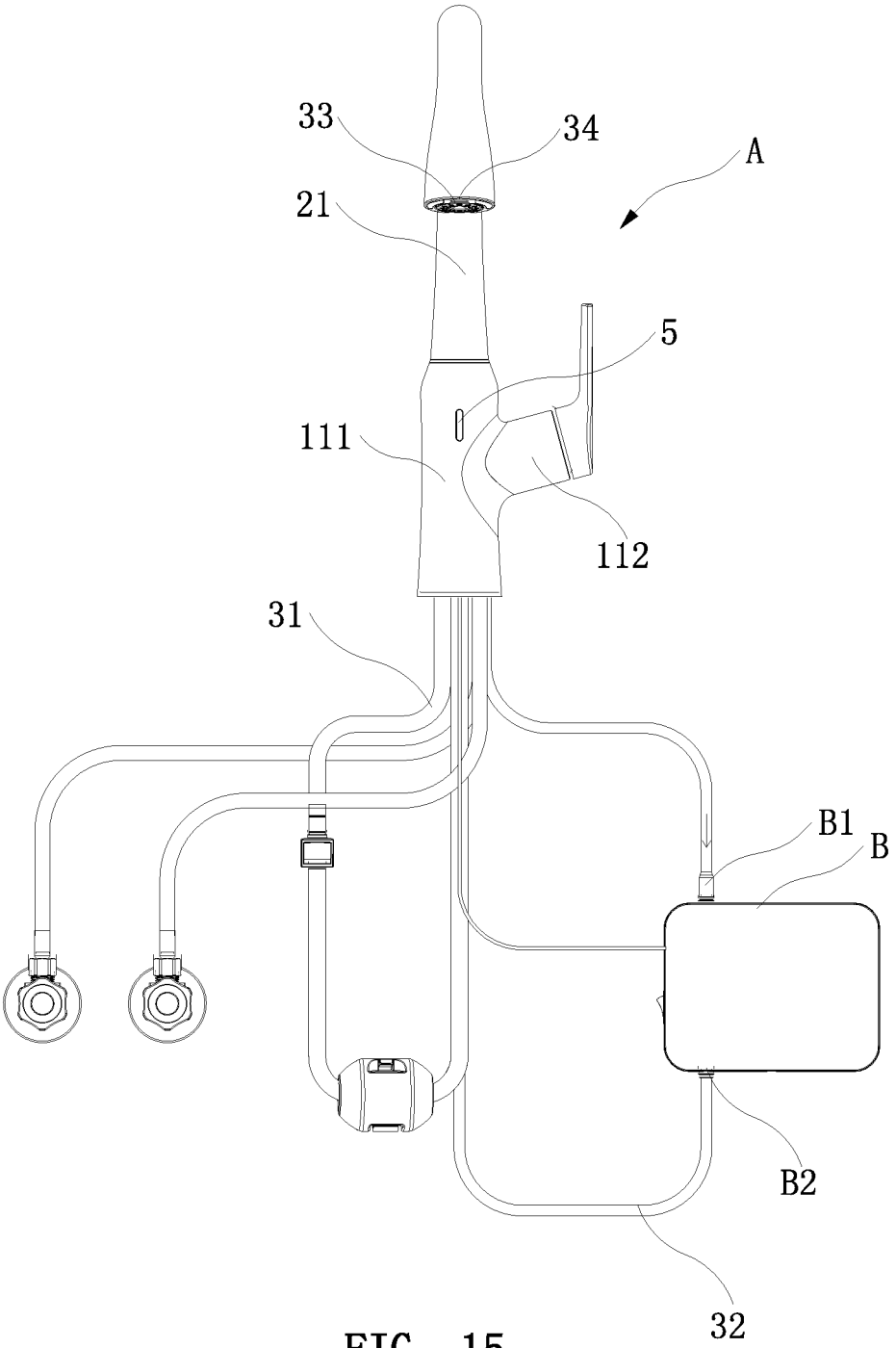
FIG. 15 is a schematic view of the dual-outlet faucet system of the present invention.

As shown in FIG. 15, the present invention further discloses a dual-outlet faucet system, comprising a water treatment apparatus B and the aforementioned dual-outlet faucet A. An inlet B1 and an outlet B2 of the water treatment apparatus B are connected to the cold water outlet 2121 of the dual-outlet faucet A and the inlet end of the second spout tube 32, respectively. When the user controls the cold water outlet 2121 to discharge water by operating the control valve core 22, the cold water output from the cold water outlet 2121 is processed by the water treatment apparatus B and then output through the second spout tube 32 and the second spray head 34. The water treatment apparatus B can select a pure water preparation device for preparing pure water. When the user controls the cold water outlet 2121 to discharge water by operating the control valve core 22, the dual-outlet faucet A outputs pure water. The water treatment apparatus B may select an ozone water generating device for generating ozone water. When the user controls the cold water outlet 2121 to discharge water by operating the control valve core 22, the dual-outlet faucet A outputs ozone water. Ozone water can be used for sterilization. The water treatment apparatus B may select an ionized water generator for generating ionized water. When the user controls the cold water outlet 2121 to discharge water by operating the control valve core 22, the dual-outlet faucet A outputs ionized water.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A dual-outlet faucet, comprising a faucet body, a control valve and a spout assembly;

the faucet body including a hollow main body and a spout body, the spout body being connected to the main body;

the control valve being installed on the main body, the control valve including a valve seat and a control valve core matched with the valve seat, the valve seat having a cold water inlet, a hot water inlet, a mixed water outlet and a cold water outlet; the control valve core being configured to control the cold water inlet and the hot water inlet to communicate with the mixed water outlet, the control valve core being further configured to control the cold water inlet to communicate with the cold water outlet; the spout assembly including a first spout tube, a second spout tube, a first spray head, and a second spray head; the first spout tube passing through the spout body and the main body, an inlet end and an outlet end of the first spout tube being connected to the mixed water outlet and the first spray head respectively; the second spout tube passing through the spout body and the main body, an outlet end of the second spout tube being connected to the second spray head.

2. The dual-outlet faucet as claimed in claim 1, wherein an outer end of the spout body is formed with an outlet port;

the first spout tube movably passes through the spout body and the main body, and the second spray head is fixed to the outlet port of the spout body.

3. The dual-outlet faucet as claimed in claim 2, wherein the second spray head has a mounting hole; the first spray head is movably accommodated in the mounting hole of the second spray head;

when the first spray head is accommodated in the mounting hole, an outer end face of the second spray head is flush with an outer end face of the first spray head.

4. The dual-outlet faucet as claimed in claim 2, wherein a partition is provided in the spout body, and the partition is configured to separate the first spout tube and the second spout tube.

5. The dual-outlet faucet as claimed in claim 4, wherein the spout body includes a vertical section and a curved section connected to the vertical section, an outer end of the curved section is formed with the outlet port; the partition includes a partition sleeve and a partition plate connected to the partition sleeve; the partition sleeve is fitted in the vertical section, the first spout tube is inserted through the partition sleeve; the partition plate is a curved plate, the partition plate is fitted in the curved section, and the partition plate is sandwiched between the first spout tube and the second spout tube.

6. The dual-outlet faucet as claimed in claim 5, wherein the partition sleeve and the partition plate are each provided with a clamp for clamping the second spout tube.

7. The dual-outlet faucet as claimed in claim 1, wherein the main body includes an upright mounting seat and a mounting cylinder connected to a side wall of the mounting seat, an inner cavity of the mounting cylinder communicates with an inner cavity of the mounting seat; the control valve core of the control valve is inserted into the mounting cylinder, the valve seat of the control valve is disposed in the mounting seat and the mounting cylinder; the spout body communicates with the mounting seat, and the first spout tube and the second spout tube pass through the mounting seat.

8. The dual-outlet faucet as claimed in claim 7, wherein a lower portion of the spout body is provided with a connecting section, a side wall of the connecting section is formed with a limiting hole;

an inner wall of the mounting seat is formed with an annular groove, the annular groove is fitted with a rotatable C-shaped ring, the connecting section is inserted into the C-shaped ring;

the C-shaped ring is provided with a limiting elastic plate, and an inner side of the limiting elastic plate is provided with a limiting block to be engaged with the limiting hole.

9. The dual-outlet faucet as claimed in claim 8, wherein the limiting block is provided with a guide slope that is inclined in a top-down direction to the inner side of the limiting elastic plate.

10. The dual-outlet faucet as claimed in claim 8, wherein an inner wall of the C-shaped ring is formed with a positioning plane, an outer wall of the connecting section of the spout body is formed with a connecting plane to be pressed against the positioning plane; and an inner wall of the annular groove of the mounting seat is formed with a recess.

11. The dual-outlet faucet as claimed in claim 10, wherein the connecting section is provided with a positioning protrusion extending downwardly, the inner wall of the mounting seat is provided with a positioning portion that extends inwardly and is configured to lean against a side of the positioning protrusion;

when the connecting section is rotated until the side of the positioning protrusion of the connecting section leans against the positioning portion of the mounting seat, the connecting section drives the C-shaped ring to rotate until the limiting elastic plate of the C-shaped ring faces the recess.

12. The dual-outlet faucet as claimed in claim 7, wherein the valve seat is formed with a notch located in the mounting seat, and the first spout tube and the second spout tube pass through the notch of the valve seat.

13. The dual-outlet faucet as claimed in claim 12, wherein the valve seat includes a main valve seat and a connecting head that are formed by injection molding; the connecting head is connected to one side of the main valve seat, and the notch is formed between the connecting head and the main valve seat.

14. The dual-outlet faucet as claimed in claim 13, wherein the main valve seat has an accommodating cavity, the cold water inlet, the hot water inlet, and the mixed water outlet; the cold water inlet, the hot water inlet and the mixed water outlet face downwardly; the accommodating cavity is provided with a first cold water entrance, a second cold water entrance, a hot water entrance, a mixed water exit and a cold water exit that are arranged parallel to each other; the first cold water entrance and the second cold water entrance are in communication with the cold water inlet; the hot water entrance is in communication with the hot water inlet; the mixed water exit is in communication with the mixed water outlet;

the connecting head of the valve seat is provided with the cold water outlet and a water passing hole communicating with the cold water outlet, the water passing hole communicates with the cold water outlet;

the control valve core is inserted into the accommodating cavity of the main valve seat, the control valve core is configured to control the first cold water entrance and the hot water entrance to communicate with the mixed water exit, and the control valve core is further configured to control the second cold water entrance to communicate with the cold water exit.

15. A dual-outlet faucet system, comprising a water treatment apparatus and the dual-outlet faucet as claimed in claim 1; an inlet and an outlet of the water treatment apparatus being connected to the cold water outlet of the dual-outlet faucet and an inlet end of the second spout tube, respectively.

* * * * *